US005267809A

United States Patent [19]

Allan

[11] Patent Number: 5,267,809

[45] Date of Patent: Dec. 7, 1993

[54] ROADMARKER DEVICE

[75] Inventor: Robert G. Allan, Springs, South Africa

[73] Assignee: Glass (SA) Holdings (Proprietary) Limited, Johannesburg, South Africa

[21] Appl. No.: 838,103

[22] Filed: Feb. 18, 1993

[30] Foreign Application Priority Data

Nov. 29, 1991 [ZA] South Africa ..... 91/9448

[51] Int. Cl.[5] ..... E01F 9/06; G02B 5/126

[52] U.S. Cl. ..... 404/14; 404/6

[58] Field of Search ..... 404/12-14, 404/16

[56] References Cited

U.S. PATENT DOCUMENTS

| | | | |
|---|---|---|---|
| 2,229,179 | 1/1941 | Langsdon | 404/16 |
| 2,328,407 | 8/1943 | Becker | 404/16 |
| 2,627,784 | 2/1953 | Peller | 404/16 |
| 3,877,785 | 4/1975 | Schaefer | 404/12 X |
| 3,922,066 | 11/1975 | Schaefer | 404/12 X |

FOREIGN PATENT DOCUMENTS

| | | |
|---|---|---|
| 764859 | 3/1934 | France . |
| 438328 | 11/1935 | United Kingdom . |
| 2166179 | 4/1986 | United Kingdom . |

*Primary Examiner*—Stephen J. Novosad
*Attorney, Agent, or Firm*—Ladas & Parry

[57] ABSTRACT

A shell 50 for a roadmarker device 10 has a body member 12 of a glass material. The body member 12 defines a chamber 14 in which a reflective element 28 is receivable. The body member 12 has a circular cylindrical base portion 16 and a raised portion 18 on top of the base portion 16. The raised portion 18, when viewed from one side of the base portion 16 is parabola-like and extends between opposed peripheries 16.1, 16.2 of the base portion 16. The raised portion 18 defines two substantially planar surfaces 20 extending in opposite directions, downwardly from a central ridge 22.

11 Claims, 2 Drawing Sheets

ROADMARKER DEVICE

THIS INVENTION relates to a roadmarker device. More particularly, the invention relates to a roadmarker device of the type commonly referred to as a "cat's-eye".

According to a first aspect of the invention, there is provided a shell for a roadmarker device, the shell including a body member which is of a substantially transparent material, the body member defining a chamber therein in which a reflective element is receivable, the body member comprising a substantially cylindrical base portion and a raised portion arranged on the base portion, the raised portion, when viewed from a side of the body member, being substantially parabola-like and extending from a first part of the periphery of the base portion to an opposed part of the periphery.

Thus, it will be appreciated that the raised portion maintains its continuity from the said first part of the periphery to the opposed part thereof. In other words, the raised part has no discontinuities therein.

The base portion is substantially cylindrical and reference to a side thereof refers to viewing the shell at right angles to the reflective element receivable therein.

The raised portion may define two substantially planar surfaces extending in opposite directions, downwardly from a central ridge. The ridge may extend between the sides (as defined above) of the body member.

The cylindrical portion may taper slightly inwardly from an operatively bottom end thereof towards the raised portion. It will be appreciated that such taper facilitates removal of the shell from a mould and also facilitates location of the body member within a road surface. Also, to locate the body member within the road surface, the cylindrical portion may have operatively vertically extending ribs and/or grooves.

In a preferred form of the invention, the body member is of an ultraviolet resistant material which has a mechanical integrity which is able to withstand the passage of a motor vehicle over it and also to withstand damage due to petro chemicals. Thus, preferably, the body member is of a glass material.

According to a second aspect of the invention, there is provided a roadmarker device which includes a body member as described above; and a reflective element arranged within the chamber to be visible through the body member when viewed externally of the body member.

At least a part of the reflective element may be arranged in a part of the chamber extending into the raised portion of the body member.

Preferably, the device includes an insert on which the reflective element is carried, the insert being receivable within the chamber of the body member.

The insert may be of a plastics material defining opposed raised faces. Each raised face may carry a strip of a reflective material thereon.

The insert may be of a plastics material and may be shaped to line at least that part of the chamber in the cylindrical portion of the body member. Hence, the insert may be a press-fit within the chamber of the body member. Thus, the insert may close off the chamber for inhibiting the ingress of moisture and/or dirt within the chamber.

A closure means plate may be receivable within the insert for closing off the interior of the insert.

The invention is now described by way of example with reference to the accompanying diagrammatic drawings.

Figure 1:
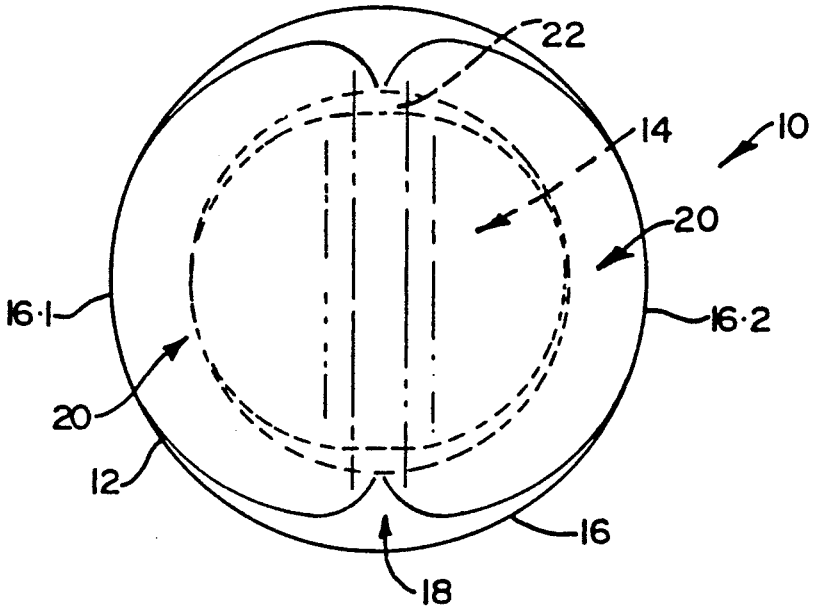
FIG. 1 shows a plan view of a roadmarker device, in accordance with the invention.

Referring to the drawings, a roadmarker device, in accordance with the invention, is illustrated and is designated generally by the reference numeral 10. The roadmarker device 10 comprises a body member 12 of a glass material. The body member 12 defines a chamber 14 therein, the chamber 14 being more clearly illustrated in FIG. 2 of the drawings.

The body member 12 comprises a substantially circular cylindrical base portion 16 and a raised portion 18 extending from the base portion 16. The raised portion 18, when viewed from a side (as defined above) of the body member 12, is substantially parabola-like and extends from a first part 16.1 of the periphery of the base portion 16 to an opposed part 16.2 of the base portion 16. More particularly, the raised portion 18 defines two substantially planar surfaces 20 extending downwardly in opposite directions from a central ridge 22 to the parts 16.1, 16.2 of the periphery of the base portion 16. The planar surfaces 20 are each at an angle of approximately 60° to the vertical.

A peripheral wall 24 of the base portion 16 tapers slightly inwardly upwardly from a bottom 26 of the body member 12. The taper of the wall 24 facilitates removal of the body member 12 from a mould and also serves to inhibit dislodgement of the device 10 from a road surface in which it is mounted in use.

Further, if desired, the wall 24 can have vertically extending ribs and/or grooves (not shown) thereon to locate the body member 12 in the road surface.

A reflective element 28 (FIG. 2) is arranged within the chamber 14 of the body member 12. The reflective element 28 comprises an insert 30 of a plastics material. The insert 30 has a raised boss 32 which is receivable in that part of the chamber 14 extending into the raised part 18 of the body member 12. The boss 32 defines opposed faces 34, each of which carries a strip 36 of a retro reflective material. The insert 30 further has a flared portion 38 which is circular in profile and which is a press fit within that part of the chamber 14 in the cylindrical base portion 16 of the body member 12. Thus, it will be appreciated that the flared portion 38 effectively seals off the chamber 14 against the ingress of moisture and/or dirt. A backing plate 40 is receivable within the flared portion 38 of the insert 30. If desired, a sealant may be applied between the backing plate 40 and an inner rim 42 of the cylindrical base portion 16, further to inhibit the ingress of dirt and/or moisture.

Additional strips 43 of reflective material are carried on the flared portion 38 of the insert 30.

Figure 2:
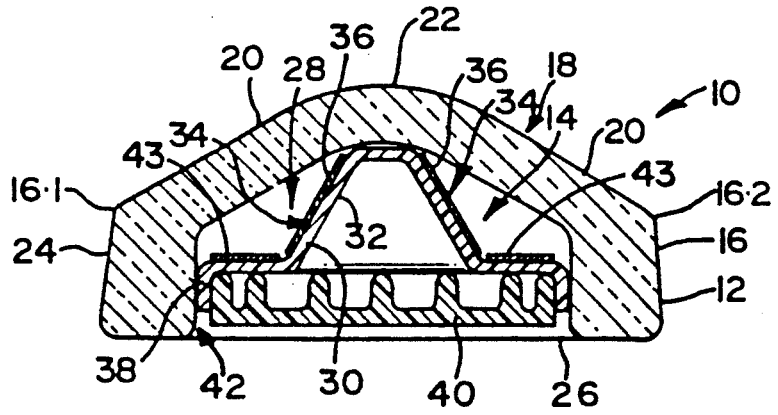
FIG. 2 shows a sectional side view of the road marker device taken along line II—II in FIG. 1.

Hence, it will be appreciated that the insert 30 as illustrated in FIG. 2 of the drawings, comprises a two-part construction, one part comprising the raised boss 32 and flared portion 38 and the other part comprising the backing plate 40 receivable within the flared portion 38.

Figure 3:
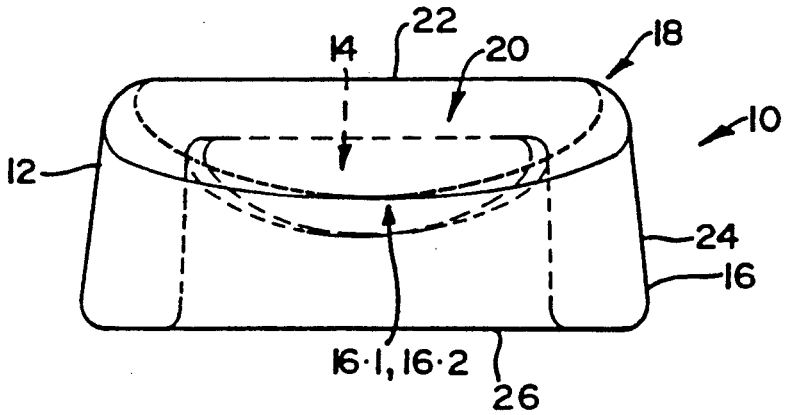
FIG. 3 shows a front view of the device with the insert omitted.
Figure 4:
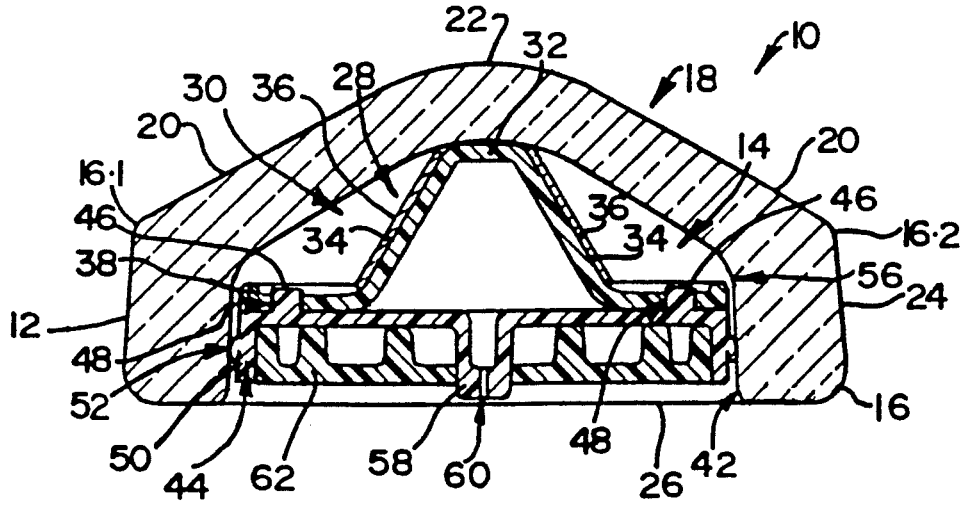
FIG. 4 shows a sectional side view of the roadmarker device including a modified insert.
Figure 5:
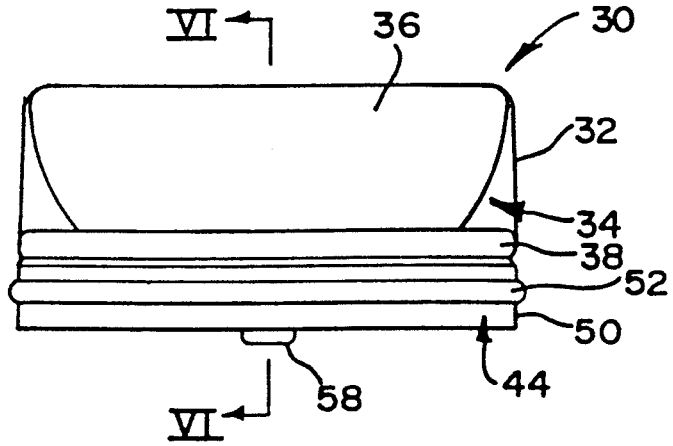
FIG. 5 shows a front view of the modified insert of the device of FIG. 4.
Figure 6:
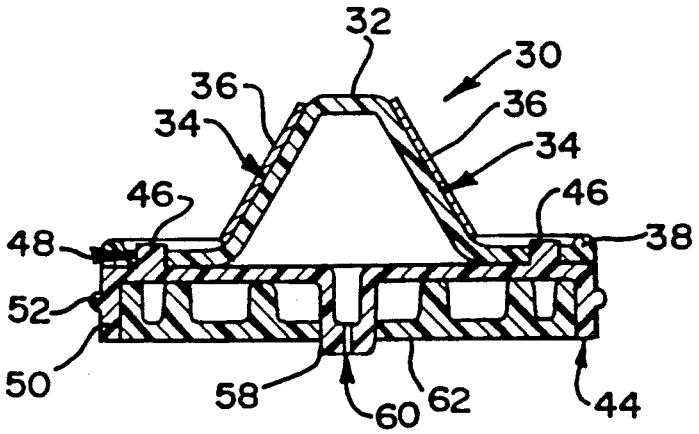
FIG. 6 shows a sectional side view of the modified insert taken along line VI—VI in FIG. 5.

Referring to FIGS. 4 to 6 of the drawings, a roadmarker device 10 including a modified insert 30 is illustrated. With reference to FIGS. 1 to 3 of the drawings, like reference numerals refer to like parts, unless otherwise specified.

The modified insert 30 is a three part construction. The first part of the insert 30 comprises the boss 32 and the flared portion 38 but, in this embodiment of the invention, the flared portion 38 is substantially flange-like.

The second part of the insert comprises a backing plate 44 which is secured to the flared portion 38. The backing plate 44 carries a pair of oppositely disposed lugs 46, the lugs 46 being receivable in complementary openings 48 in the flared portion 38. After insertion of the lugs 46 into the openings 48, the lugs 46 are heat welded in position.

The backing plate 44 includes a downwardly depending skirt portion 50 having an annular rib 52 on an operatively outer surface thereof. The rib 52, when the backing plate 44 is inserted into the chamber 14 of the body member 12, is deformed and bears sealingly against an inner wall 56 of the cylindrical portion 16 of the body member 12.

The backing plate 44 is of a resiliently flexible plastics material to enable the rib 52 to deform and seal against the inner wall 56 of the cylindrical portion 16 of the body member 12.

The backing plate 44 further has a central formation 58 defining a pinhole-like passage 60 therethrough. The first part of the modified insert 30 also has such a pinhole (not shown) in it. The purpose of these pinholes is to enable air to be expelled from the chamber 14 when the insert 30 is inserted into the chamber 14.

The third part of the modified insert 30 comprises a backing plug 62 which is a press-fit in the skirt portion 50 of the backing plate 44. Unlike the backing plate 44, the plug 62 is of a substantially rigid material. Thus, once the plug 62 has been inserted into the backing plate 44, it ensures that the rib 52 is maintained in position against the inner wall 56 in a substantially sealing manner.

It will be appreciated that as the insert 30 is urged into the chamber 14 of the body member 12 of the roadmarker device 10, the air within the chamber is expelled through the pinhole in the first part of the modified insert 30 and the passage 60 in the backing plate 44. The passage 60 is then sealed by heat welding and the central formation 58 is also heat welded to the backing plug 62 to ensure retention of the backing plug 62 in position. The central formation 58 is also deformed to flatten it so that it does not protrude beyond the bottom of the body member 12.

With the provision of a raised portion 18 which is substantially continuous, i.e. having no discontinuities therein, dirt build up on the roadmarker device 10 is obviated and, by having the angled planar surfaces 20, the roadmarker device 10 is substantially self cleaning due to the passage of vehicle tires over it.

The Applicant has found that, surprisingly, having the angled planar surfaces 20 does not, in any way, adversely affect the performance of the roadmarker device 10 insofar as it relates to its reflective capabilities.

What is claimed is:

1. A shell for a roadmarker device, the shell including a body member which is of a substantially transparent material, the body member defining a chamber therein in which a reflective element is receivable, the body member comprising a substantially cylindrical base portion and a raised portion arranged on said base portion, the raised portion, when viewed from a side of the body member, being substantially parabola-like and extending from a first part of the periphery of said base portion to an opposed part of the periphery and the raised portion defining two substantially planar surfaces extending in opposite directions, downwardly from a central ridge.

2. The shell as claimed in claim 1, in which the ridge extends between the sides of the body member.

3. The shell as claimed in claim 1, in which the substantially cylindrical base portion tapers slightly inwardly from an operatively bottom end thereof towards the raised portion.

4. The shell as claimed in claim 1, in which the body member is of an ultraviolet-resistant material which has a mechanical integrity which is able to withstand the passage of a motor vehicle over it and also to withstand damage due to petro-chemicals.

5. The shell as claimed in claim 4, in which the body member is of a glass material.

6. A roadmaker device which includes a body member as claimed in claim 1, and a reflective element arranged within the chamber to be visible through the body member when viewed externally of the body member.

7. The device as claimed in claim 6, in which at least a part of the reflective element is arranged in a part of the chamber extending into the raised portion of the body member.

8. The device as claimed in claim 6, which includes an insert on which the reflective element is carried, the insert being receivable within the chamber of the body member.

9. The device as claimed in claim 8, in which the insert is of a plastics material defining opposed raised faces, each raised face carrying a strip of a reflective material thereon.

10. The device as claimed in claim 8, in which the insert is of a plastics material and is shaped to line at least that part of the chamber in the substantially cylindrical base portion of the body member.

11. The device as claimed in claim 10, in which a closure means is receivable within the insert for closing off an interior of the insert.

* * * * *

UNITED STATES PATENT AND TRADEMARK OFFICE

CERTIFICATE OF CORRECTION

PATENT NO. : 5,267,809

DATED : December 7, 1993

INVENTOR(S) : Robert G. ALLAN

It is certified that error appears in the above-identified patent and that said Letters Patent is hereby corrected as shown below:

On title page, left column, item 22, "1993" should be -- 1992 --.

Signed and Sealed this

Ninth Day of August, 1994

Bruce Lehman

*Attest:*

BRUCE LEHMAN

*Attesting Officer*

*Commissioner of Patents and Trademarks*